United States Patent [19]

White

[11] 3,950,215

[45] Apr. 13, 1976

[54] HONEYCOMB MATERIALS

[75] Inventor: Desmond Deverell White, Dyserth, England

[73] Assignee: Dufaylite Developments, Ltd., St. Neots, England

[22] Filed: Apr. 8, 1974

[21] Appl. No.: 458,956

[52] U.S. Cl. ..... 156/558; 156/559; 156/578; 93/1 H

[51] Int. Cl.[2] ..... B31D 3/02

[58] Field of Search ..... 156/578, 558, 559, 546, 156/547, 598, 197, 295, 580; 93/1 H

[56] References Cited

UNITED STATES PATENTS

| | | | |
|---|---|---|---|
| 2,409,777 | 10/1946 | Maurer | 156/558 |
| 2,537,918 | 1/1951 | Skoog | 156/558 |
| 2,731,379 | 1/1956 | Wheeler | 156/558 |
| 3,713,954 | 1/1973 | Clark et al. | 156/197 X |

*Primary Examiner*—Charles E. Van Horn
*Assistant Examiner*—M. G. Wityshyn
*Attorney, Agent, or Firm*—William Anthony Drucker

[57] ABSTRACT

Apparatus for producing continuous unexpanded honeycomb material from slices of unexpanded material has a magazine for delivering the slices to a ramming station in turn, a ramming device for ramming them from the station in their expansion direction through a gripping guideway, and an adhesive applicator for applying adhesive to the slices so that they adhere together in the guideway under the ramming pressure. Provision may be made for feeding the magazine with layers of unexpanded slices from a stillage.

The apparatus may be joined to a machine for lapping the unexpanded material for storage or transport if required.

2 Claims, 4 Drawing Figures

HONEYCOMB MATERIALS

Figure 1:
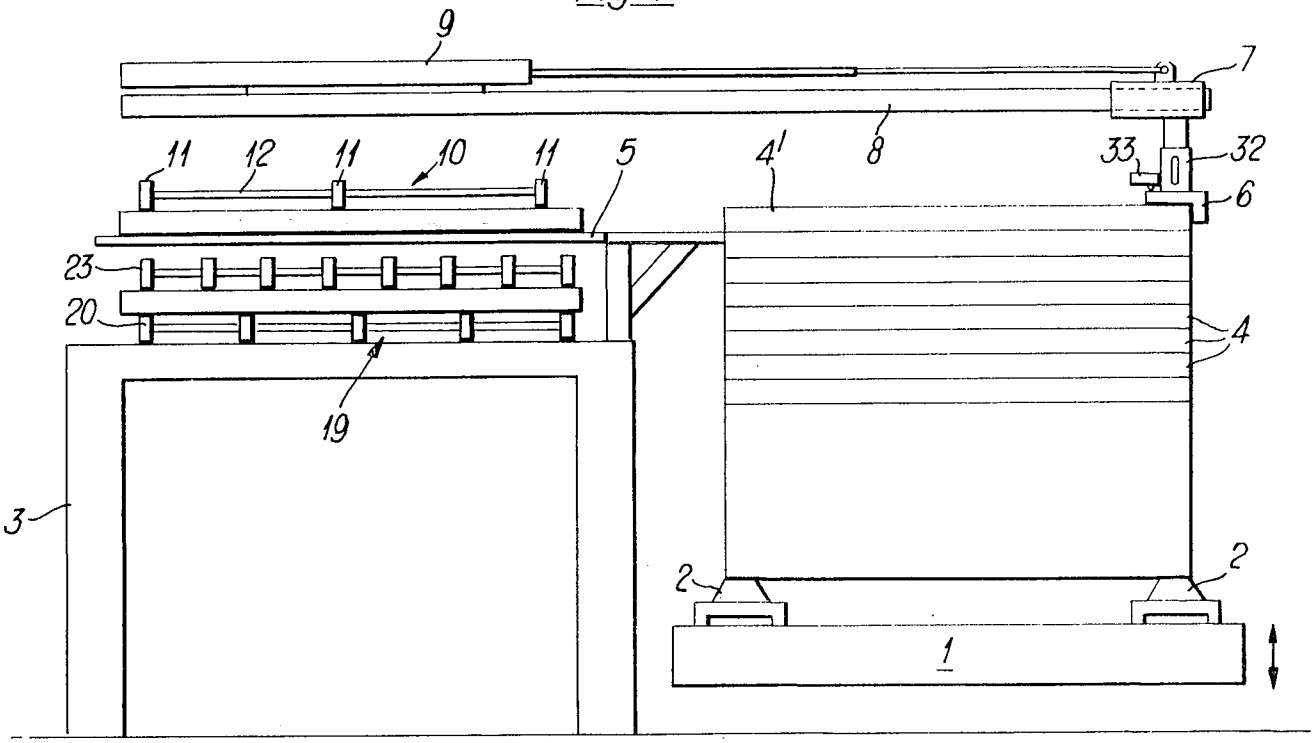

The present invention relates to structural honeycomb materials and especially to apparatus for providing said materials in a readily usable form.

In British Patent No. 591,772 there has been described the production of structural honeycomb material by slicing blocks formed of layers of sheet material, usually paper or thin cardboard, adhesively secured together by bands of adhesive. The slices thus obtained are expandable to the open cellular, normally generally hexagonal state by pulling them open in a direction corresponding with the thickness direction of the blocks. Forming slices in this way gives great versatility in production as it is a simple matter to vary the thickness of the slices cut from the blocks. It is also simple to change the width of sheet material used in forming the blocks, and/or the spacing between the bands of adhesive. The versatility is obtained together with a commercially satisfactory rate of production but the provision of the material in the form of slices is inconvenient for some purposes. Problems arise in handling them automatically, and there can be cutting losses when the size of expanded material required is not an integral multiple of that obtained from a single slice.

The manufacture of the material in a continuous form is a known alternative to manufacture in slices, but tends to be more expensive to be less versatile, and to introduce handling problems.

An object of the present invention is to provide an apparatus by which structural honeycomb material in continuous form may be produced economically from material manufactured in the form of slices.

In accordance with the present invention, there is provided apparatus for adhesively securing together slices of structural honeycomb material in the unexpanded state to form continuous expandable material which comprises a magazine for holding a supply of the slices and delivering them singly to a ramming station, a guideway leading from the ramming station for receiving the slices from the ramming station and holding the received slices positively located, ramming apparatus at the ramming station for ramming the slices into and through the guideway in turn by moving them in their expansion direction against the reaction of slices previously rammed into the guideway and an adhesive applicator for applying to the slices, adhesive positioned to adhere the slices together as they are rammed through the guideway.

The adhesive applicator may be carried by the ramming device and serves to transmit the ramming force of the ramming device to the slices.

With the apparatus, slices so glued that they are readily securable together to form continuously expandable material are obtainable in a simple and economic manner. Moreover, the rate of production of the glued slices depends upon the rate at which the ejector, conveniently a pneumatic ejector, is operated. Thus the rate may be arranged such that it matches immediate requirements. No storage of glued slices or continuous material produced therefrom is required to compensate for the interruption of, or use at a variable rate of, the continuous material.

For many purposes it is unnecessary for the continuous material to be absolutely uniform in its properties. Useful results may therefore be obtained with an adhesive applicator which places the adhesive continuously along the lengths of the slices or in patches unrelated in their positioning to the positions of the adhesive in the slices. However, if it is necessary to minimise irregularity of expansion, or to avoid lack of expansion between the last layer of one slice and the first layer of the next, the applicator can be provided in such form that the adhesive is correctly registered with the adhesive in the slices. If necessary the applicator may be arranged to change the registration of the adhesive from slice to slice to ensure uniformity of continuous material produced from slices containing an odd number of layers.

The ejection of the slices in their expansion direction enables the continuous material to be formed by assembling them together without change of orientation. It is no difficult matter to provide a robust ejector driven by a pneumatic or other fluid-actuated ram of sufficient power to drive the ejected slices in contact through a distance sufficient, and under a pressure sufficient, to allow good adhesion to take place.

In a construction suitable for partially manual operation, the feedway has two feedway-defining members adapted to define a feedway for holding the slices therein, one of said members being movable, preferably pivotally movable, away from feedway defining relationship with the other into a loading position in which it may be loaded with slices for the supply and subsequently movable back to the feedway defining relationship to carry the loaded slices into the feedway. Loading the movable feedway-defining member manually with a set of slices pushed into contact with the abutment is adequately fast for most purposes. Discontinuity of operation is well tolerated and its occurrences may be minimised if the magazine extends beyond the movable member. Pneumatic or other driving actuators may be provided for moving the loaded movable feedway-defining member back to the feedway defining relationship and for moving the abutment when the loaded slices have been carried into position.

In a construction suitable for purely, or nearly purely, automatic operation the magazine comprises a horizontal platform for holding the supply of slices and a drive for advancing the supply of slices along the platform for delivery to the ramming station. A carrier may be provided for holding a stack of layers of the slices, e.g. in a fork-lift stillage, together with a sliding device operable to slide the layers on to the platform in turn, each to serve as a supply of slices. Advantageously, the carrier is an elevator device with an incremental drive for raising it by the thickness of one layer after each operation of the sliding device.

Figure 2:
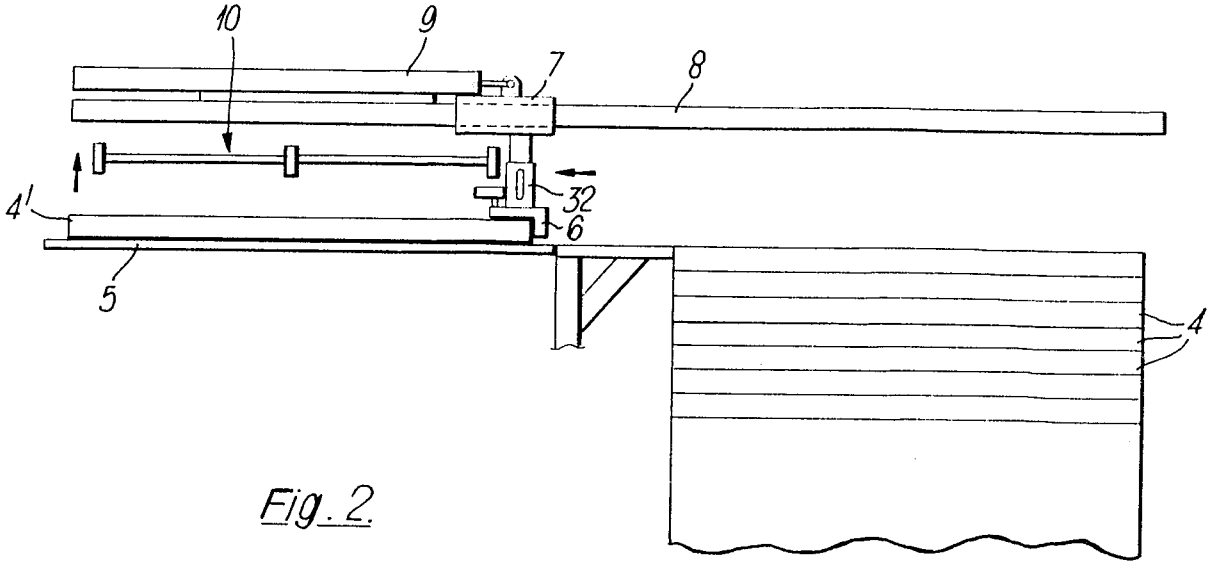
Figure 3:
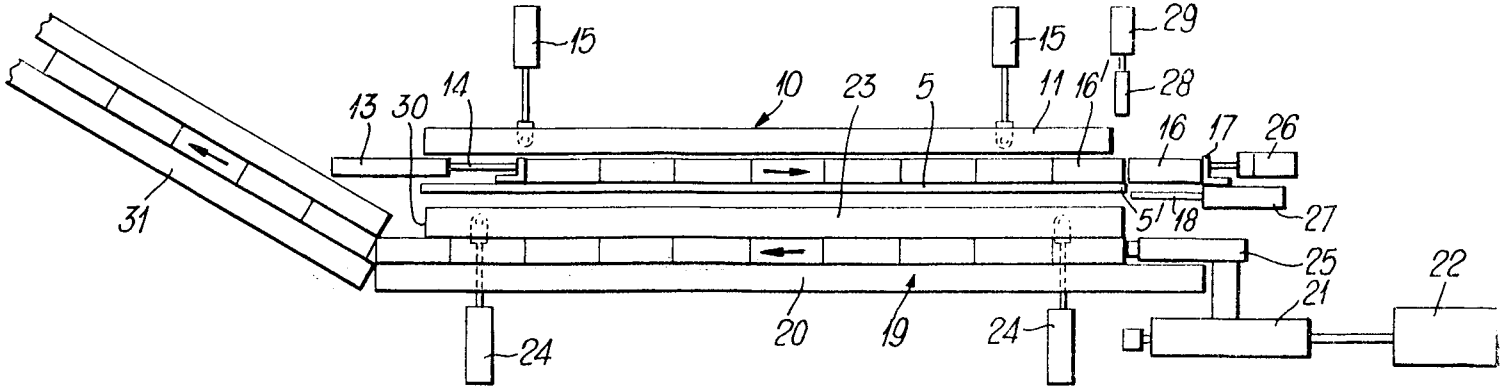
Figure 4:
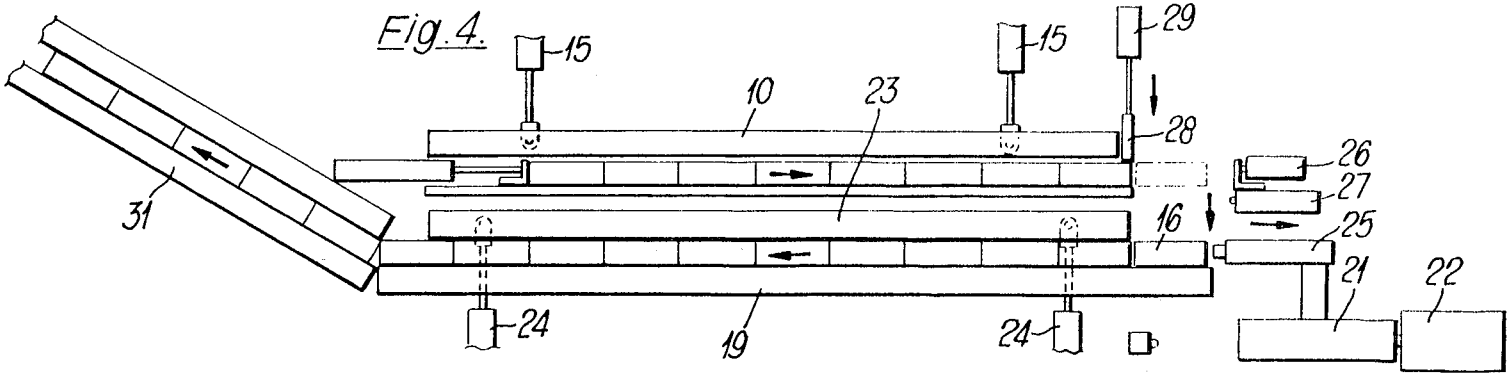

The following description of a preferred embodiment of the apparatus, in which description reference is made to the accompanying diagrammatic drawings, is given in order to illustrate the invention. In the drawings:

FIG. 1 shows the apparatus from one end thereof, viz. the end away from which the slices are rammed into the guideway, FIG. 2 repeats the principal part of FIG. 1. but with operative parts in a different position, FIG. 3 shows the apparatus from one side thereof, viz. the side to the left in FIGS. 1 and 2, and FIG. 4 repeats the principal part of FIG. 3, but with the operative parts in a different position.

In FIG. 1 a lift platform 1 for a fork-lift stillage 2 is shown mounted beside the fixed framework 3 of the main part of the apparatus. The stillage holds layers 4 of slices of honeycomb material oriented so that the expansion direction is perpendicular to the plane of FIG. 1. A hydraulic lifting mechanism (not shown) is operated as required to bring the bottom of the then uppermost layer 4' level with platform 5. When platform 5 is empty, a set of shoes 6 mounted on a head 7 movable along a track 8 by a pneumatic ram 9, slides the uppermost layer 4' on to platform 5 (FIG. 2) and then returns to the position shown in FIG. 1. The hydraulic mechanism can be operated to raise the stillage 2 at any time after the shoes 6 have returned to their FIG. 1 position.

An upper clamp 10 formed of longitudinal bars 11 linked by transverse rods 12 is raised whilst the layer is being moved on to the platform 5 and is thereafter lowered to grip the constituent slices against the platform.

Referring to FIGS. 3 and 4, the slices are fed to the rear 5' of the platform 5 by a pneumatic ram 13, driving a pressure bar 14, under the upper clamp 10 whilst downward pressure is maintained by rams 15 which also serve for raising clamp 10 to the position shown in FIG. 2. The rearward slice 16 passes over the rear 5' of the platform to be pressed into contact with a check bar 17 and extend over a shutter 18 in the form of a set of forwardly projecting rods. Check bar 17 is positioned such that the whole horizontal thickness of slice 16 is clear of the rear 5' of the platform.

Slice 16 is then allowed to fall, by retraction of check bar 17 and shutter 18 on to a horizontal machine bed 19 in the form of a set of parallel rails 20. A ram 21 is driven forward by a pneumatic actuator 22 to ram the slice 16 forward under a clamp 23 of similar construction to clamp 10. The ends of the rails 20 constituting the machine bed project horizontally beyond the end of clamp 23, as shown in FIGS. 3 and 4, to provide supporting means at a ramming station for receiving the slices in turn. In FIG. 4 the ramming station is shown occupied by slice 16. Pneumatic rams 24 urge the clamp 23 downwardly so that the slices are gripped whilst being rammed between bed 20 and clamp 23.

Ram 21 engages slice 16 via a gluing head 25 fed through flexible conduits with liquid adhesive and arranged to apply patches of adhesive spaced apart along the length of slice 16, preferably one patch between each pair of patches of adhesive by which the rearmost constituent strip of the slice is secured to the next strip so that there will be no cellular discontinuity in the continuous honeycomb material being produced.

Check bar 17 and shutter 18 are driven forward by actuating rams 26 and 27 into a position for receiving the next slice 16' from platform 5 and retracted to allow slice 16' to fall on to machine bed 19 after slice 16 has been rammed forward and gluing head 25 retracted by actuator 22. A clamp 28 is forced down by an actuator 29 and prevents slices being advanced over the end of the platform 5 when check bar 17 is retracted (Compare FIGS. 3 and 4).

The cycle of ramming the slices in turn between the bed 19 and the clamp 23 continues until the platform 5 is cleared of slices. Then the upper clamp 10 is raised, and bar 14 is retracted, to receive a further layer of slices from the stillage 2. Operation continues until the stillage is emptied. Platform 10 is then lowered and the stillage replaced by a full one.

As the slices travel forward between bed 19 and clamp 23 they are restrained from sliding relative to one another and pressed tightly together. These conditions allow bonding to be obtained from the adhesive, e.g. an aqueous dextrin adhesive used with paper honeycomb applied by gluing head 25, and sound continuous unexpanded honeycomb is obtained at the end 30 of the bottom clamp. It may be taken direct from the apparatus to a manufacturing point, e.g. for the production of doors or other panels, via a feedway 31. No difficulty is encountered in running the apparatus intermittently to meet an irregular demand.

The shoes 6 may be carried by pneumatic actuators at 32 (FIG. 1) and lowered into position for engaging the top layer in the stillage 2, motion being stopped by a microswitch 33. This arrangement is useful when thin slices, susceptible to warping, have to be handled.

Instead of feeding the continuous honeycomb to a manufacturing point, the honeycomb may be packaged for storage or for sale without further processing.

It will be understood that various departures may be made from the specific form of apparatus described herein without departing from the ambit of the invention.

I claim:

1. Apparatus for adhesively securing together slices of structural honeycomb material in the unexpanded state to form continuous expandable material which comprises a magazine for holding a supply of the slices and delivering them singly to supporting means at a ramming station, a guideway leading from the ramming station for receiving the slices from the ramming station and holding the received slices positively located, a ramming device for ramming the slices into and through the guideway in turn by ramming them by ramming force in their expansion direction against the reaction of slices previously rammed into the guideway and an adhesive applicator for applying to the slices, adhesive positioned to adhere the slices together as they are rammed through the guideway said adhesive applicator being carried by the ramming device and serving to transmit the ramming force of the ramming device to the slices.

2. Apparatus according to claim 1 in which the adhesive applicator is arranged to apply the adhesive in patches spaced apart along the slices.

* * * * *